US009625095B2

(12) United States Patent
Spittael et al.

(10) Patent No.: US 9,625,095 B2
(45) Date of Patent: Apr. 18, 2017

(54) SEALED AND INSULATING RESERVOIR TO CONTAIN A PRESSURIZED COLD FLUID

(71) Applicant: GAZTRANSPORT ET TECHNIGAZ, Saint-Rémy-lès-Chevreuse (FR)

(72) Inventors: Laurent Spittael, Voisins-le-Bretonneux (FR); Bruno Deletre, Versailles (FR); David Lafare, Gif-sur-Yvette (FR); Pierre Jolivet, Thiverval-Grignon (FR); David Hassler, Orsay (FR); Amaury Mange, Montigny-le-Bretonneux (FR); Benoit Capitaine, Vélizy-Villacoublay (FR); Ali Abdallah, Montigny-le-Bretonneux (FR)

(73) Assignee: GAZTRANSPORT ET TECHNIGAZ, Saint-Rémy-lès-Chevreuse (FR)

( * ) Notice: Subject to any disclaimer, the term of this patent is extended or adjusted under 35 U.S.C. 154(b) by 0 days.

(21) Appl. No.: 14/434,014

(22) PCT Filed: Sep. 27, 2013

(86) PCT No.: PCT/FR2013/052291

§ 371 (c)(1),
(2) Date: Apr. 7, 2015

(87) PCT Pub. No.: WO2014/057186

PCT Pub. Date: Apr. 17, 2014

(65) Prior Publication Data

US 2015/0292678 A1 Oct. 15, 2015

(30) Foreign Application Priority Data

Oct. 9, 2012 (FR) ..... 12 59589

(51) Int. Cl.
*F17C 1/12* (2006.01)
*F17C 1/00* (2006.01)
(Continued)

(52) U.S. Cl.
CPC ..... *F17C 1/12* (2013.01); *F17C 1/00* (2013.01); *F17C 3/04* (2013.01); *F17C 13/02* (2013.01);
(Continued)

(58) Field of Classification Search
CPC ..... F17C 2201/0185; F17C 2201/019; F17C 2203/0316; F17C 2203/0362;
(Continued)

(56) References Cited

U.S. PATENT DOCUMENTS 1,376,359 A * 4/1921 Quigley ..... F17C 1/00 137/206
1,692,670 A * 11/1928 Le Mesurier ..... F17C 1/04 220/585
(Continued)

FOREIGN PATENT DOCUMENTS

FR 2 412 783 7/1979
FR 2412783 A1 7/1979
(Continued)

OTHER PUBLICATIONS

Written Opinion, Sep. 27, 2013.
(Continued)

*Primary Examiner* — Ryan J Walters
*Assistant Examiner* — Erik Mendoza-Wilkenfe
(74) *Attorney, Agent, or Firm* — Notaro, Michalos & Zaccaria P.C.

(57) ABSTRACT

A sealed and insulating reservoir contains a pressurized cold fluid in a rigid, sealed enclosure. A fluidtight membrane is positioned to contact the cold fluid contained in the reservoir. An insulating barrier is placed between the fluidtight membrane and the internal surface of the rigid enclosure, with the insulating barrier forming a support surface to support the fluidtight membrane. A pressure balancing
(Continued)

device is able to limit the pressure difference between a first sealed volume located inside the fluidtight membrane, and a second sealed volume located outside the fluidtight membrane. The pressure balancing device typically includes a fluid circuit having two chambers sealingly separated by a movable separator. The first chamber is linked to the first sealed volume, and the second chamber is linked to the second sealed volume. The movable separator exerts a loading force in the direction of the second chamber.

20 Claims, 5 Drawing Sheets

(51) Int. Cl.

| | |
|---|---|
| ***F17C 3/04*** | (2006.01) |
| ***F17C 13/02*** | (2006.01) |
| ***F17C 13/04*** | (2006.01) |
| ***F17C 13/12*** | (2006.01) |

(52) U.S. Cl.
CPC ..... *F17C 13/025* (2013.01); *F17C 13/04* (2013.01); *F17C 13/126* (2013.01); *F17C 2201/0104* (2013.01); *F17C 2201/0157* (2013.01); *F17C 2201/054* (2013.01); *F17C 2203/0304* (2013.01); *F17C 2203/0333* (2013.01); *F17C 2203/0358* (2013.01); *F17C 2203/0375* (2013.01); *F17C 2203/0629* (2013.01); *F17C 2203/0631* (2013.01); *F17C 2203/0643* (2013.01); *F17C 2203/0682* (2013.01); *F17C 2205/0326* (2013.01); *F17C 2205/0332* (2013.01); *F17C 2205/0335* (2013.01); *F17C 2205/0388* (2013.01); *F17C 2205/0394* (2013.01); *F17C 2221/033* (2013.01); *F17C 2223/0161* (2013.01); *F17C 2223/035* (2013.01); *F17C 2227/0302* (2013.01); *F17C 2250/01* (2013.01); *F17C 2250/032* (2013.01); *F17C 2250/043* (2013.01); *F17C 2250/0434* (2013.01); *F17C 2250/0478* (2013.01); *F17C 2250/0491* (2013.01); *F17C 2250/0626* (2013.01); *F17C 2250/0678* (2013.01); *F17C 2260/012* (2013.01); *F17C 2260/042* (2013.01); *F17C 2265/066* (2013.01); *F17C 2270/0105* (2013.01); *F17C 2270/0107* (2013.01)

(58) Field of Classification Search
CPC ..... F17C 2203/0266; F17C 2203/0387; F17C 2203/0695; F17C 2203/068; F17C 2203/069; F17C 2205/0391; F17C 2250/043; F17C 2250/0434
See application file for complete search history.

(56) References Cited

U.S. PATENT DOCUMENTS

| | | | | |
|---|---|---|---|---|
| 2,677,939 A * | 5/1954 | Clute | ..... | F17C 1/00 137/202 |
| 2,922,287 A * | 1/1960 | Rae | ..... | F17C 3/10 220/560.12 |
| 4,372,340 A * | 2/1983 | Rothrock | ..... | F17C 3/022 137/395 |
| 4,399,831 A * | 8/1983 | Robert | ..... | B64G 1/402 137/154 |
| 2009/0252598 A1* | 10/2009 | Snider | ..... | F02C 3/22 415/116 |

FOREIGN PATENT DOCUMENTS

| | | |
|---|---|---|
| WO | 2007-084007 A1 | 7/2007 |
| WO | WO 2007/084007 | 7/2007 |
| WO | 2010-119213 A2 | 10/2010 |
| WO | WO 2010/119213 | 10/2010 |

OTHER PUBLICATIONS

International Search Report for PCT/FR2013/052291 filed Sep. 27, 2013.
Written Opinion for PCT/FR2013/052291 filed Sep. 27, 2013.

* cited by examiner

SEALED AND INSULATING RESERVOIR TO CONTAIN A PRESSURIZED COLD FLUID

The invention relates to the domain of reservoirs able to contain pressurized fluids, in particular cold or hot fluids, and more specifically liquefied natural gas.

A cryogenic, pressure-resistant reservoir in the form of a rigid metal enclosure made of cryogenic steel directly in contact with the cold fluid and surrounded externally by thermal insulation is known. However, such an enclosure, which needs to be withstand both high pressure (for example 3-6 bar) and low temperature (for example −163° C.), requires a large quantity of particularly costly metal alloys.

According to one embodiment, the invention provides a sealed and insulating reservoir to contain a pressurized cold fluid, the reservoir comprising:

a rigid, sealed enclosure, a fluidtight membrane intended to come into contact with the cold fluid contained in the reservoir, an insulating barrier placed between the fluidtight membrane and the internal surface of the rigid enclosure, the insulating barrier forming a support surface to support the fluidtight membrane, and a pressure balancing device able to limit a pressure difference between a first sealed volume located inside the fluidtight membrane and a second sealed volume located outside the fluidtight membrane.

According to the embodiments, such a reservoir may have one or more of the following features.

According to one embodiment, the balancing device includes an automatic pressure regulation device linked to the second sealed volume that is able to increase or reduce the pressure in the second sealed volume as a function of a pressure setpoint.

According to one embodiment, the automatic pressure regulation device is able to determine the pressure setpoint as a function of a pressure measured in the first sealed volume.

According to one embodiment, the automatic pressure regulation device includes a controlled compressor able to inject a gas into the second sealed volume to increase the pressure in the second sealed volume, in particular to regulate the pressure in the second sealed volume as a function of the pressure difference between the two volumes.

According to one embodiment, the cold fluid consists of methane in liquid state and the gas in the second volume consists of methane in gas state. Preferably in this case, the automatic pressure regulation device includes a heater of which an inlet is linked to the first sealed volume, the heater being able to supply the compressor with methane gas obtained by heating the liquid or gaseous methane drawn from the first sealed volume.

According to one embodiment, the automatic pressure regulation device includes a controlled valve able to connect the second sealed volume to a first relief reservoir to reduce the pressure in the second sealed volume.

According to one embodiment, the controlled compressor has a suction pipe linked to the relief reservoir.

According to one embodiment, the balancing device includes a first pressure limiting device able to move the fluid from the second sealed volume to the first sealed volume when the pressure in the second sealed volume exceeds the pressure in the first sealed volume beyond a first predetermined positive threshold.

Such a pressure limiting device prevents the membrane from being ripped off the supporting element of same by an excessive pressure drop in the first sealed volume.

According to one embodiment, the balancing device includes a second pressure limiting device able to move the fluid from the first sealed volume to the second sealed volume when the pressure in the first sealed volume exceeds the pressure in the second sealed volume beyond a second predetermined positive threshold.

Such a pressure limiting device prevents the membrane from being damaged by excessive overpressure in the first sealed volume. However, such a membrane is usually more resistant to overpressure, which compresses same against the supporting element of same, than to pressure drops, which tend to rip same away.

According to one embodiment, the second positive value is greater than the first positive value.

According to one embodiment, the balancing device includes a fluid circuit having two chambers separated sealingly by a movable separator, a first of the chambers being linked to the first sealed volume and a second of the chambers being linked to the second sealed volume, the movable separator being able to exert a loading force in the direction of the second chamber to maintain a positive pressure difference between the second sealed volume and the first sealed volume.

According to one embodiment, the movable separator includes a sliding piston in a cylinder, the loading force being exerted by a spring coupled to the piston.

According to one embodiment, the movable separator includes a quantity of liquid contained in the fluid circuit, the fluid circuit including a portion oriented vertically in the gravitational field to produce the loading force hydrostatically.

According to one embodiment, the balancing device includes a fluid circuit including a linking pipe having two chambers separated sealingly by a separator arranged moveably in the linking pipe, a first of the chambers being linked to the first sealed volume and a second of the chambers being linked to the second sealed volume, the fluid circuit including a discharge pipe having an opening into the linking pipe, the movable separator being moveable between neutral positions, in which the moveable separator blocks the opening of the discharge pipe such as to sealingly separate the discharge pipe from the first and second chambers, and discharge positions, in which the movable separator uncovers the opening of the discharge pipe such as to fluidly connect the discharge pipe with one of the first and second chambers.

According to one embodiment, the balancing device also has a return member coupled to the movable separator to force the movable separator towards a neutral position.

According to one embodiment, the reservoir also includes:

a secondary fluidtight membrane and a secondary insulation barrier arranged between the insulation barrier and the internal surface of the rigid enclosure, and a second pressure balancing device able to limit a pressure difference between a third sealed volume located between the rigid enclosure and the secondary fluidtight membrane and the second sealed volume, the second sealed volume being located between the first fluidtight membrane and the second fluidtight membrane.

According to one embodiment, the first fluidtight membrane is metallic and the or each insulation barrier is made up of a plurality of juxtaposed insulating blocks.

According to one embodiment, the invention also provides a fuel supply system for an energy generation facility, for example one carried on board a ship or located on land, the supply system including the aforementioned reservoir filled with a quantity of liquefied gas in two-phase equilibrium at a relative pressure that may exceed 3 bar, and a supply circuit linking the reservoir to the energy generation facility to supply the pressurized gas to the energy generation facility.

An idea at the heart of the invention is to use membrane-reservoir technology to create a reservoir with relatively high pressure levels, for example between 3 and 10 bar. This technology uses a relatively small amount of metal for the primary sealing function, which helps to reduce costs, even if special alloys need to be used. This technology also makes it possible to thermally insulate the load-bearing structure in which the reservoir is built, in relation to the fluid contained in the tank, such that the load-bearing structure can be made using traditional materials that costs less than materials designed to withstand extreme temperatures.

Certain aspects of the invention are based on the idea of safely controlling the pressure difference between the two sides of a fluidtight membrane to protect the fluidtight membrane from any substantial stresses that may be caused by such a difference. Certain aspects of the invention are based on the idea of providing several independent control devices to improve the operational reliability of such control.

The invention is further explained, along with additional objectives, details, characteristics and advantages thereof, in the detailed description below of several specific embodiments of the invention given solely as non-limiting examples, with reference to the drawings attached.

Figure 1:
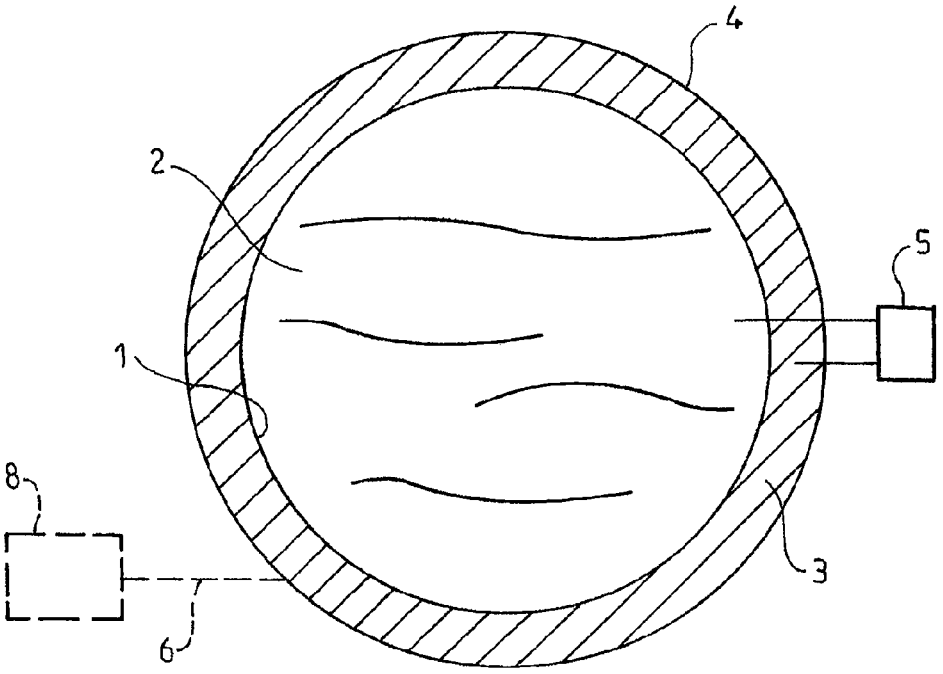
FIG. 1 is a schematic cross-section of a reservoir according to a first embodiment.

With reference to FIG. 1, a reservoir with an overall cylindrical shape is shown along a transverse cross-section, containing a liquid 2 under relative positive pressure, i.e. an absolute pressure greater than ambient atmospheric pressure. The reservoir wall comprises successively, from the inside to the outside, a primary membrane 1, for example made of metal, that contains the liquid 2 directly, a layer of thermally insulating material 3 the internal surface of which supports the primary membrane 1, and an external rigid enclosure 4, for example made of steel.

A pressure balancing system 5 acts on the pressure inside the primary membrane 1 and/or on the pressure outside the primary membrane 1 in the insulating layer 3, such as to keep the pressure difference between these two spaces within predefined limits. Consequently, the pressure balancing device 5 ensures that the pressure inside the fluidtight membrane 1 is essentially withstood by the external rigid enclosure 4, and not by the fluidtight membrane 1, such that the fluidtight membrane 1 and the insulating layer 3 need only withstand the weight of the liquid 2. The external rigid enclosure 4 is dimensioned as a function of the anticipated operating pressure range of this reservoir.

According to a possible application, the liquid 2 is a liquefied natural gas (LNG), i.e. a mixture with a high methane content stored at a pressure of 3 to 6 bar and at a very negative liquid-vapor equilibrium temperature. This pressurized LNG can in particular be used to supply the thermal engines 8 of an LNG carrier ship, or any similar engine, via the supply pipe 6 shown schematically in FIG. 1.

The pressure balancing device 5 may include one or more pressure control means, examples of which are given below.

Figure 2:
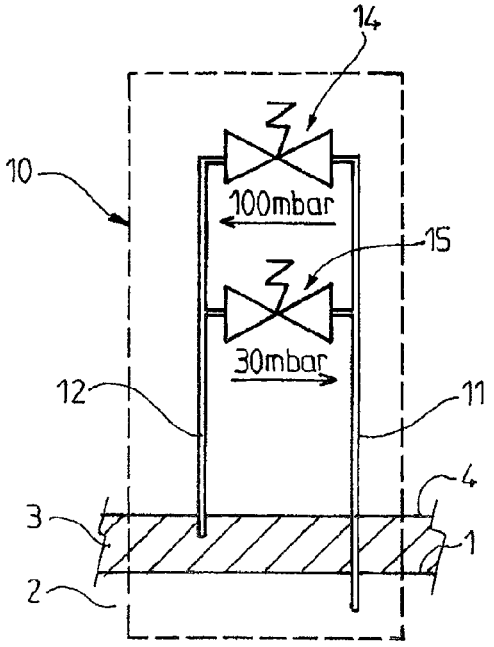
FIG. 2 is a schematic representation of a valved safety device that can be used with the reservoir in FIG. 1.

FIG. 2 shows a valved safety device 10 that ensures that the pressure Pe outside the membrane 1 remains within the following limits about the pressure Pi inside the membrane 1:

$$Pi-100\text{ mbar}<Pe<Pi+30\text{ mbar} \qquad \text{Eq. (1)}$$

The safety device 10 includes a pipe 11 linked to the space inside the membrane 1, a pipe 12 linked to the space outside the membrane 1 and two pressure limiting devices 14 and 15 assembled in parallel and in opposing directions between the pipes 11 and 12. The pressure limiting device 14 opens to enable the fluid to escape from the pipe 11 to the pipe 12 when the pressure difference reaches a threshold of +100 mbar. The pressure limiting device 15 opens to enable the fluid to escape from the pipe 12 to the pipe 11 when the pressure difference reaches a threshold of +30 mbar. This simple, reliable device nonetheless has the drawback of introducing cold fluid into the insulating layer 3, thereby cooling the external rigid enclosure 4.

Figure 6:
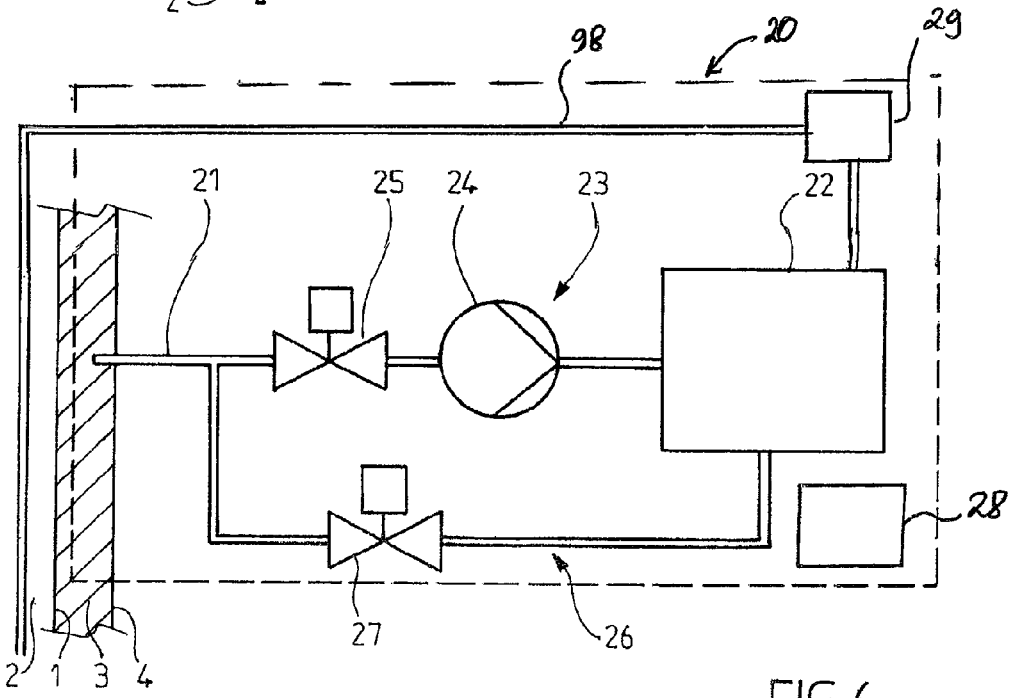
FIG. 6 is a schematic representation of an automatic pressure regulation system that can be used with the reservoir in FIG. 1.

FIG. 6 shows an automatic pressure regulation system 20 used to regulate the pressure in the space outside the membrane 1 through the controlled injection and extraction of a fluid. The system 20 includes a pipe 21 opening into the insulating layer 3, a pressurized fluid reservoir 22 for storing the regulation fluid, an injection circuit 23 linking the reservoir 22 to the pipe 21 to inject fluid from the reservoir to the insulating layer 3, and a parallel extraction circuit 26 linking the reservoir 22 to the pipe 21 to extract fluid from the insulating layer 3 to the reservoir 22.

The injection circuit 23 includes a compressor 24 that draws from the reservoir 22 and discharges into the pipe 21 through a solenoid valve 25. The extraction circuit 26 includes a solenoid valve 27 between the reservoir 22 and the pipe 21. The solenoid valves 25 and 27, as well as the compressor 24, are controlled by a control device 28 as a function of the pressure values Pi and Pe measured inside and outside the membrane 1 by a measurement system (not shown). Thus, the system 20 regulates the pressure P1 as a function of the predefined setpoint, which may be identical to the equation (1) above.

If the liquid 2 contained in the reservoir is a liquefied gas, for example LNG, it is advantageous to use the same substance in gas state as regulation fluid for the system 20, i.e. methane gas in the case of LNG. This substance in gas state can be obtained from the previously heated liquefied gas. To do so, the system 20 includes a heating device 29 linked to the space inside the reservoir by a pipe 98 arranged to draw the liquid phase 2 from the bottom of the reservoir 1.

In a variant, a different gas can be used to regulate the pressure in the insulation space 3 in relation to the content of the reservoir 1. In this case, the pipe 98 is not used, the reserve of the different gas being the reservoir 22.

In a variant not shown, the reservoir 22 contains the pressurized gas such that it can be injected directly into the insulation space 3. In this case, the compressor 24 can be assembled in the other direction to discharge into the reservoir 22 and draw from the pipe 21 via the solenoid valve 25.

Figure 3:
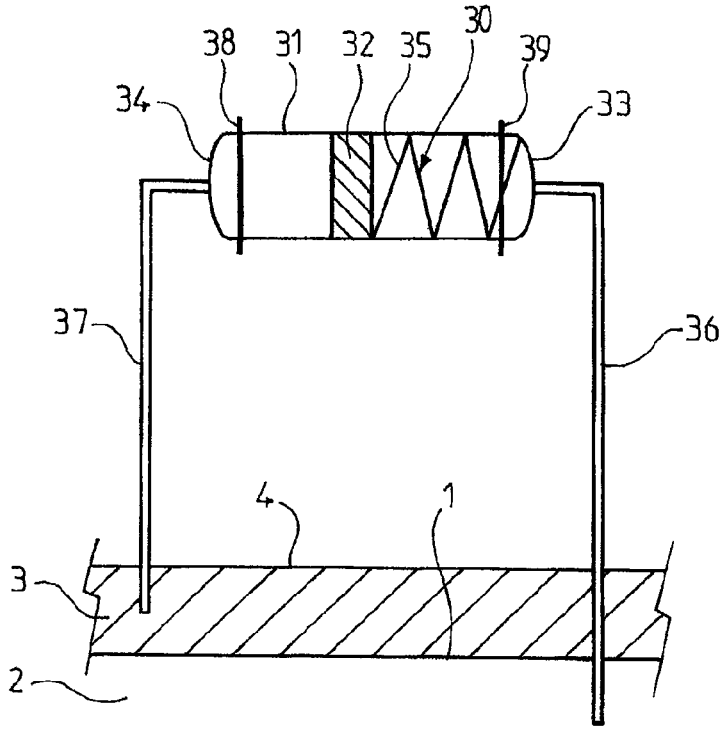
FIG. 3 is a schematic representation of a mechanical pressure regulation device that can be used with the reservoir in FIG. 1.

With reference to FIG. 3, the description below relates to a mechanical device 30 used to regulate the pressure Pe within a limited range above the pressure value Pi, such as to absorb slight pressure variations. The mechanical device 30 is a piston pressure accumulator including a cylindrical enclosure 31, a piston 32 sliding sealingly within the cylindrical enclosure 31, and a compression spring 35 seated in the cylindrical enclosure 31 between the piston 32 and an extremity 33 of the enclosure to load the piston towards the opposite extremity 34. A pipe 36 links the extremity 33 of the enclosure 31 to the space inside the membrane 1 and a pipe 37 links the extremity 34 of the enclosure 31 to the space outside the membrane 1.

When in use, the device 30 maintains an overpressure in the space outside the membrane 1, for example around 100 mbar, in particular complementing the action of the regulation system 20, in order to limit the interventions of the system 20.

According to one embodiment, the position sensors 38 and 39 detect the extreme positions reached by the piston 32, which correspond to the desired pressure setpoints being exceeded, and then send the corresponding control signals, for example to the regulation system 20.

Figure 4:
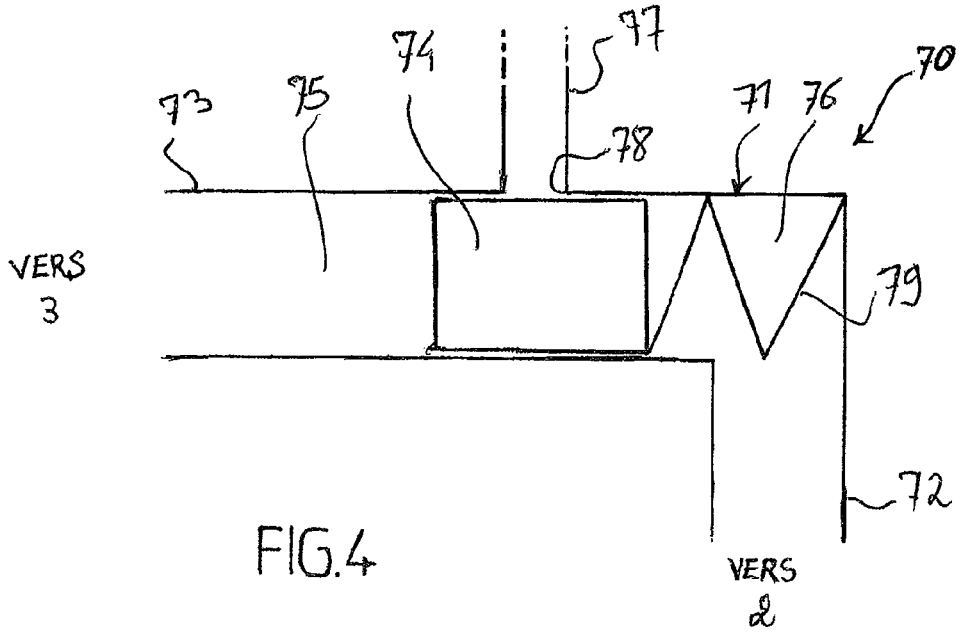
FIG. 4 is a schematic representation of another mechanical safety device regulating a pressure difference between two adjacent spaces that can be used with the reservoir in FIG. 1.

FIG. 4 shows a mechanical safety device 70 used to create a discharge from the space inside the membrane 1 or the space outside the membrane 1 towards a reference pressure, for example towards atmospheric pressure, when the pressure Pi or the pressure Pe gets too high, for example as a result of a malfunction of a regulation device.

The safety device 70 includes a main pipe 71 one extremity 72 of which is linked to the space inside the membrane 1 and an opposite extremity 73 is linked to the space outside the membrane 1. A very thick piston 74 slides sealingly inside the pipe 71 such as to separate, within the pipe 71, a first volume 75 linked to the space outside the membrane 1 via the extremity 73 and a second volume 76 linked to the space inside the membrane 1 via the extremity 72.

A discharge pipe 77 opens into an intermediate portion of the main pipe 71 level with an opening 78 to connect the pipe 71 with a reference pressure, for example atmospheric pressure. In a corresponding embodiment, the pipe 77 includes a mast, the upper extremity of which opens into the environment.

The piston 74 is shown in a neutral position in which it blocks the opening 78 sealingly. On account of the thickness of same, the piston 74 can slide within a given range without uncovering the opening 78 in response to small variations in the pressure values Pe and Pi. However, if the difference |Pe−Pi| becomes too great, the piston 74 slides within whichever of the volumes 75 and 76 in which the pressure is lowest until it uncovers the opening 78, thereby connecting the other volume 75 or 76, in which the pressure is higher, to the discharge pipe 77 to quickly reduce this high pressure. The safety device 70 is designed to be used in a reservoir where the two pressure values Pe and Pi are and remain greater than the reference pressure.

An elastic return spring 79 seated in the pipe 71 connects the piston 74 to the wall of the pipe 71 such as to return the piston 74 to the neutral position if the pressure difference |Pe−Pi| is reduced.

Figure 5:
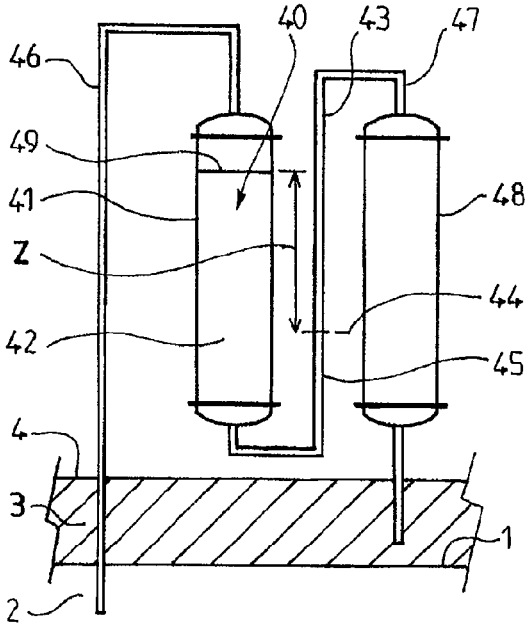
FIG. 5 is a schematic representation of another mechanical pressure regulation device that can be used with the reservoir in FIG. 1.

FIG. 5 shows a hydrostatic device 40 used to regulate the pressure Pe within a limited range above the pressure value Pi, such as to absorb slight pressure variations. The hydrostatic device 40 includes a vertical cylindrical enclosure 41 containing a first quantity of liquid 42, a syphon tube 43 that rises from the base of the enclosure 41 to contain a second quantity of liquid 45, the interface 44 of which has been shown for illustrative purposes. A pipe 46 links the top of the enclosure 41 to the space inside the membrane 1. A pipe 47 provided with an overflow reservoir 48 links the top of the syphon tube 43 to the space outside the membrane 1.

The hydrostatic device 40 is an alternative to the mechanical device 30 and can perform the same functions. In particular, it exerts an overpressure ΔP equal to:

$$\Delta P = \rho \cdot g \cdot z \qquad \text{Eq. (2)}$$

Where ρ is the mass density of the liquid 42, g is the acceleration of gravity and z is the difference in level between the two interfaces 44 and 49 of the liquid, the rest of the device 40 being filled with gas.

According to a preferred embodiment, several of the devices described above are provided in combination to control the pressure Pe with several levels of safety and sensitivity. In particular, the devices 10, 20 and 30 or 10, 20 and 40 can be combined on the same reservoir.

Figure 7:
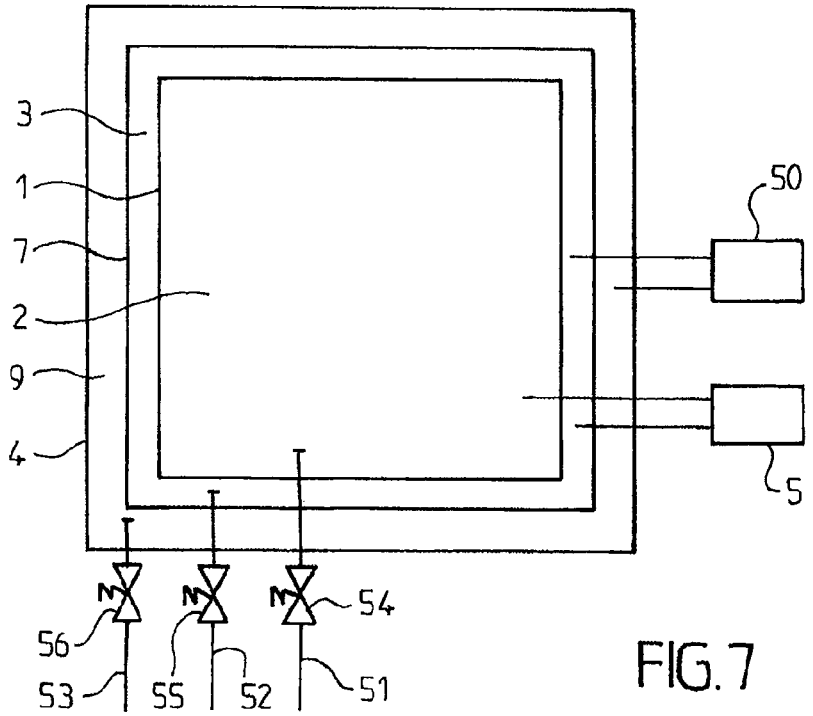
FIG. 7 is a schematic cross-section of a reservoir according to a second embodiment.

FIG. 7 shows another reservoir containing a pressurized liquid 2. The elements similar to the elements in FIG. 1 are indicated using the same reference signs. The reservoir in FIG. 7 includes two successive fluidtight membranes, i.e. the primary membrane 1 and the secondary membrane 7, arranged between the primary insulating layer 3 and a secondary insulating layer 9.

To protect the secondary membrane 7 from excessive stresses, a second pressure balancing system 50 acts in the same manner as described above on the pressure inside the secondary membrane 7 and/or on the pressure outside the secondary membrane 7 in the insulating layer 9, such as to contain the pressure difference between these two spaces within predefined limits. The system 50 may include one or more of the devices described with reference to the system 5.

According to one embodiment, the pressure Ps in the secondary space 9 is regulated using the setpoint:

$$Pe + 2\ \text{mbar} < Ps < Pe + 7\ \text{mbar} \qquad \text{Eq. (3)}$$

Furthermore, FIG. 7 shows the filling pipes 51, 52, 53 controlled by the valves 54, 55, 56 for respectively the space inside the primary membrane 1, the primary space 3 and the secondary space 9. According to one embodiment, the working pressure in these different spaces is approximately 6 bar.

Numerous techniques can be used to make the fluidtight membranes and the insulating layers. Preferably, the membranes are made of fine sheets of welded metal. For the insulating layers, modular constructions based on insulating blocks are advantageous.

Figure 8:
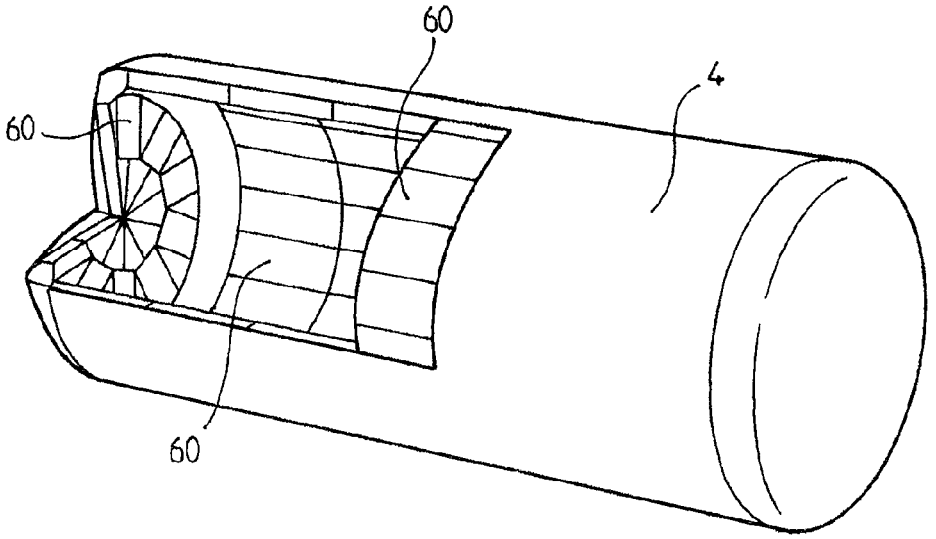
FIG. 8 is a cut-away schematic perspective view of a reservoir according to a third embodiment.

FIG. 8 shows an example embodiment of such insulating blocks 60 on the different walls of the cylindrical reservoir. Other reservoir geometries are also possible, for example polyhedral or parallelepiped.

Figure 9:
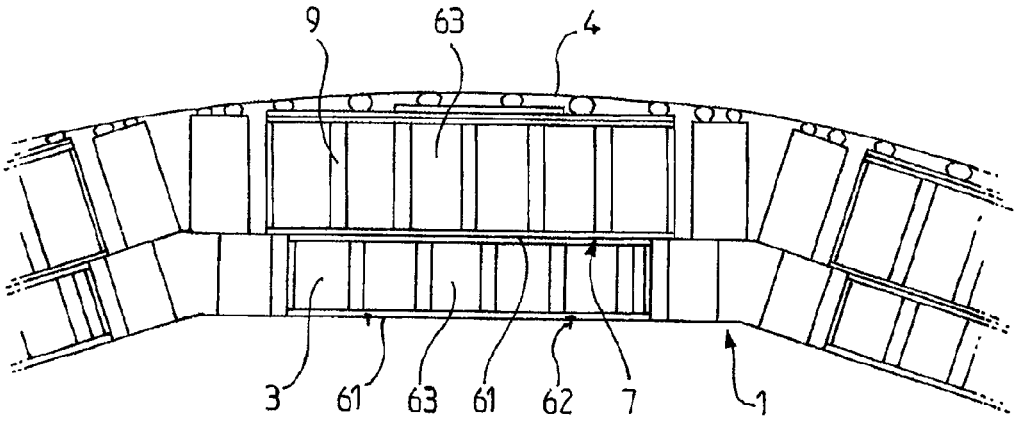
FIG. 9 is a schematic cross-section of a wall structure suitable for building the reservoir in FIG. 8.

FIG. 9 shows in greater detail a membrane wall structure that can be used inside the rigid enclosure 4. The primary and secondary fluidtight membranes 1, 3 are in this case made of flat strakes 61 with raised edges made of an alloy with a high nickel content and very low coefficient of thermal expansion, known as Invar®. The primary and secondary insulating layers 3, 9 are made from juxtaposed boxes 63, the structure of which is for example made of plywood and that are filled with a non-structural insulator such as perlite or glass wool. The raised edges of two adjacent strakes 61 are in each case welded on either side of an elongated welding supporting element 62 that is held on the cover panel of the boxes 63. Such an implementation is also well known in LNG carrier ships.

Figure 10:
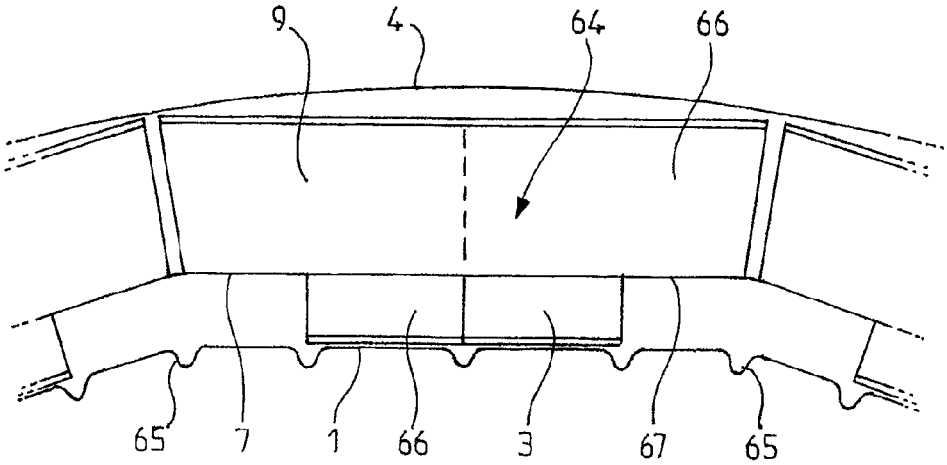
FIG. 10 is a schematic cross-section of another wall structure suitable for building the reservoir in FIG. 8.

FIG. 10 shows in greater detail another membrane wall structure that can be used inside the rigid enclosure 4. The primary fluidtight membrane 1 is in this case made of sheets of stainless steel having networks of secant corrugations 65 to provide elasticity in all directions of the plane. The primary and secondary insulating layers 3, 9 and the secondary fluidtight membrane 7 are made from prefabricated panels 64 having a respective polyurethane foam layer 66 for each insulating barrier and a thickness of fluidtight composite material 67 bonded between the two foam layers 66 to form the secondary fluidtight membrane 7. The fluidtight composite material 67 has a metal sheet and fiberglass mats bound using a polymer resin. Such an implementation is also well known in LNG carrier ships.

Although the invention has been described in relation to several specific embodiments, it is evidently in no way limited thereto and it includes all of the technical equivalents of the means described and the combinations thereof where these fall within the scope of the invention.

Use of the verb "comprise" or "include", including when conjugated, does not exclude the presence of other elements or other steps in addition to those mentioned in a claim. Use of the indefinite article "a" or "one" for an element or a step does not exclude, unless otherwise specified, the presence of a plurality of such elements or steps.

In the claims, reference signs between parentheses should not be understood to constitute a limitation to the claim.

The invention claimed is:

1. A sealed and insulating reservoir to contain a pressurized cold fluid, the reservoir comprising:

a rigid, sealed enclosure (4), a fluidtight membrane (1) intended to come into contact with the pressurized cold fluid contained in the reservoir, an insulating barrier (3) placed between the fluidtight membrane and an internal surface of the rigid enclosure, the insulating barrier forming a support surface to support the fluidtight membrane, and a pressure balancing device (5) able to limit a pressure difference between a first sealed volume (2) located inside the fluidtight membrane and a second sealed volume (3) located outside the fluidtight membrane, wherein the balancing device includes a fluid circuit (30, 40) having two chambers separated sealingly by a movable separator (32, 42), a first of the chambers being linked to the first sealed volume (2) and a second of the chambers being linked to the second sealed volume (3) and in which the movable separator is able to exert a loading force in a direction of the second chamber in response to a positive pressure difference between the second sealed volume and the first sealed volume and a loading force in a direction of the first chamber in response to a positive pressure difference between the first sealed volume and the second sealed volume, wherein the movable separator includes a quantity of liquid (42, 45) contained in the fluid circuit (41, 43), the fluid circuit including a portion (41) oriented vertically in a gravitational field to produce the loading force hydrostatically.

2. The reservoir as claimed in claim 1, further comprising: a secondary fluidtight membrane (7) and a secondary insulation barrier (9) arranged between the insulation barrier (3) and the internal surface of the rigid enclosure (4), and a second pressure balancing device (50) able to limit a pressure difference between a third sealed volume (9) located between the rigid enclosure and the secondary sealed membrane and the second sealed volume (3), the second sealed volume being located between the first fluidtight membrane (1) and the second fluidtight membrane (7).

3. A fuel supply system for an energy generation facility, the fuel supply system including the reservoir as claimed in claim 1 filled with a quantity of liquefied gas (2) in two-phase equilibrium at a relative pressure above 3 bar, and a supply circuit (6) linking the reservoir to the energy generation facility (8) to supply the pressurized liquefied gas to the energy generation facility.

4. A sealed and insulating reservoir to contain a pressurized cold fluid, the reservoir comprising:

a rigid, sealed enclosure (4), a fluidtight membrane (1) intended to come into contact with the pressurized cold fluid contained in the reservoir, an insulating barrier (3) placed between the fluidtight membrane and an internal surface of the rigid enclosure, the insulating barrier forming a support surface to support the fluidtight membrane, and a pressure balancing device (5) able to limit a pressure difference between a first sealed volume (2) located inside the fluidtight membrane and a second sealed volume (3) located outside the fluidtight membrane, wherein the balancing device includes a fluid circuit (30, 40) having two chambers separated sealingly by a movable separator (32, 42), a first of the chambers being linked to the first sealed volume (2) and a second of the chambers being linked to the second sealed volume (3) and in which the movable separator is able to exert a loading force in a direction of the second chamber in response to a positive pressure difference between the second sealed volume and the first sealed volume and a loading force in a direction of the first chamber in response to a positive pressure difference between the first sealed volume and the second sealed volume, wherein the fluid circuit includes a linking pipe (71) including the two separated chambers, the fluid circuit including a discharge pipe (77) having an opening (78) into the linking pipe, the movable separator (74) being moveable between neutral positions, in which the moveable separator blocks the opening of the discharge pipe such as to sealingly separate the discharge pipe from the first and second chambers, and discharge positions, in which the movable separator uncovers the opening of the discharge pipe such as to fluidly connect the discharge pipe with one of the first and second chambers.

5. The reservoir as claimed in claim 4, wherein the balancing device also has a return member (79) coupled to the movable separator to force the movable separator towards a neutral position.

6. The reservoir as claimed in claim 4, further comprising: a secondary fluidtight membrane (7) and a secondary insulation barrier (9) arranged between the insulation barrier (3) and the internal surface of the rigid enclosure (4), and a second pressure balancing device (50) able to limit a pressure difference between a third sealed volume (9) located between the rigid enclosure and the secondary sealed membrane and the second sealed volume (3), the second sealed volume being located between the first fluidtight membrane (1) and the second fluidtight membrane (7).

7. The reservoir as claimed in claim 4, in which the first fluidtight membrane (1) is metallic and/or each insulation barrier is made up of a plurality of juxtaposed insulating blocks (60, 63, 64).

8. A fuel supply system for an energy generation facility, the fuel supply system including the reservoir as claimed in claim 4 filled with a quantity of liquefied gas (2) in two-phase equilibrium at a relative pressure above 3 bar, and a supply circuit (6) linking the reservoir to the energy generation facility (8) to supply the pressurized liquefied gas to the energy generation facility.

9. The reservoir as claimed in claim 4, wherein the movable separator includes a sliding piston (32) in a cylinder (31), the loading force being exerted by a spring (35) coupled to the piston.

10. A sealed and insulating reservoir to contain a pressurized cold fluid, the reservoir comprising:

a rigid, sealed enclosure (4), a fluidtight membrane (1) intended to come into contact with the pressurized cold fluid contained in the reservoir, an insulating barrier (3) placed between the fluidtight membrane and an internal surface of the rigid enclosure, the insulating barrier forming a support surface to support the fluidtight membrane, and a pressure balancing device (5) able to limit a pressure difference between a first sealed volume (2) located inside the fluidtight membrane and a second sealed volume (3) located outside the fluidtight membrane, wherein the balancing device includes a fluid circuit (30, 40) having two chambers separated sealingly by a movable separator (32, 42), a first of the chambers being linked to the first sealed volume (2) and a second of the chambers being linked to the second sealed volume (3) and in which the movable separator is able to exert a loading force in a direction of the second chamber in response to a positive pressure difference between the second sealed volume and the first sealed volume and a loading force in a direction of the first chamber in response to a positive pressure difference between the first sealed volume and the second sealed volume, in which the balancing device includes an automatic pressure regulation device (20) linked to the second sealed volume that is able to increase or reduce the pressure in the second sealed volume as a function of a pressure setpoint, wherein the automatic pressure regulation device includes a control device able to determine the pressure setpoint as a function of a pressure measured in the first sealed volume by a measurement system.

11. The reservoir as claimed in claim 10, wherein the automatic pressure regulation device (20) includes a controlled compressor (24) able to inject a gas into the second sealed volume to regulate the pressure in the second sealed volume.

12. The reservoir as claimed in claim 11, wherein the pressurized cold fluid consists of methane in liquid state and the gas in the second volume consists of methane in gas state, the automatic pressure regulation device (20) including a heater (29) of which an inlet is linked to the first sealed volume (2), the heater (29) being able to supply the compressor (24) with methane gas obtained by heating the liquid or gaseous methane drawn from the first sealed volume (2).

13. The reservoir as claimed in claim 10, in which the automatic pressure regulation device (20) includes a controlled valve (27) able to connect the second sealed volume to a first relief reservoir (22) to reduce the pressure in the second sealed volume.

14. The reservoir as claimed in claim 11, wherein the controlled compressor has a suction pipe linked to the relief reservoir (22).

15. The reservoir as claimed in claim 10, wherein the movable separator includes a sliding piston (32) in a cylinder (31), the loading force being exerted by a spring (35) coupled to the piston.

16. The reservoir as claimed in claim 10, further comprising: a secondary fluidtight membrane (7) and a secondary insulation barrier (9) arranged between the insulation barrier (3) and the internal surface of the rigid enclosure (4), and a second pressure balancing device (50) able to limit a pressure difference between a third sealed volume (9) located between the rigid enclosure and the secondary sealed membrane and the second sealed volume (3), the second sealed volume being located between the first fluidtight membrane (1) and the second fluidtight membrane (7).

17. A fuel supply system for an energy generation facility, the fuel supply system including the reservoir as claimed in claim 10 filled with a quantity of liquefied gas (2) in two-phase equilibrium at a relative pressure above 3 bar, and a supply circuit (6) linking the reservoir to the energy generation facility (8) to supply the pressurized liquefied gas to the energy generation facility.

18. A sealed and insulating reservoir to contain a pressurized cold fluid, the reservoir comprising:

a rigid, sealed enclosure (4), a fluidtight membrane (1) intended to come into contact with the pressurized cold fluid contained in the reservoir, an insulating barrier (3) placed between the fluidtight membrane and an internal surface of the rigid enclosure, the insulating barrier forming a support surface to support the fluidtight membrane, and a pressure balancing device (5) able to limit a pressure difference between a first sealed volume (2) located inside the fluidtight membrane and a second sealed volume (3) located outside the fluidtight membrane, wherein the balancing device includes a fluid circuit (30, 40) having two chambers separated sealingly by a movable separator (32, 42), a first of the chambers being linked to the first sealed volume (2) and a second of the chambers being linked to the second sealed volume (3) and in which the movable separator is able to exert a loading force in a direction of the second chamber in response to a positive pressure difference between the second sealed volume and the first sealed volume and a loading force in a direction of the first chamber in response to a positive pressure difference between the first sealed volume and the second sealed volume, in which the balancing device includes a first pressure limiting device (15) able to move the fluid from the second sealed volume (3) to the first sealed volume (2) when the pressure in the second sealed volume exceeds the pressure in the first sealed volume beyond a first predetermined positive threshold.

19. The reservoir as claimed in claim 18, in which the pressure balancing device includes a second pressure limiting device (14) able to move the fluid from the first sealed volume (2) to the second sealed volume (3) when the pressure in the first sealed volume exceeds the pressure in the second sealed volume beyond a second predetermined positive threshold.

20. The reservoir as claimed in claim 19 wherein the second positive threshold is greater than the first positive threshold.

* * * * *